US005197358A

United States Patent [19]

Hsu

[11] Patent Number: 5,197,358

[45] Date of Patent: Mar. 30, 1993

[54] SOCKET WRENCH

[76] Inventor: C. C. Frank Hsu, No. 28, Chung-Hsing E. Rd., Tai-Ping Hsiang, Taichung Hsien, Taiwan

[21] Appl. No.: 943,636

[22] Filed: Sep. 11, 1992

[51] Int. Cl.[5] ..... B25B 13/46

[52] U.S. Cl. ..... 81/60

[58] Field of Search ..... 81/58, 58.4, 59.1, 60, 81/61, 63.1; 192/45.1

[56] References Cited

U.S. PATENT DOCUMENTS

| | | | |
|---|---|---|---|
| 1,157,427 | 10/1915 | Seivert | 81/60 |
| 2,898,790 | 8/1959 | Lazar et al. | 81/60 |
| 2,982,161 | 5/1961 | Angquist et al. | 81/60 |
| 3,019,682 | 2/1962 | Hare | 81/61 |
| 4,515,044 | 5/1985 | Harstad | 81/61 |

*Primary Examiner*—J. J. Swann

*Attorney, Agent, or Firm*—Shlesinger, Arkwright & Garvey

[57] ABSTRACT

A socket wrench has a box end which confines an internal wall therein. A pair of rollers are connected rigidly by an eccentric shaft and are received in the box end. A pair of retaining plates are provided in the box end on both sides of the box end so as to retain the rollers therein. A resilient plate is provided between the rollers adjacent to the eccentric shaft. An inverted V-shaped rigid pawl member is provided around the eccentric shaft and includes a first and second section. The first section includes a curved first side formed adjacent to the internal wall of the box end, a straight second side forming a first clearance with the eccentric shaft and a free end interconnecting the curved first and straight second sides and which is biased by the resilient plate so that at least a portion of the curved first side adjacent to the resilient member frictionally abuts with the internal wall. The second section includes a third straight side connected to the curved first side and forming a second clearance between the internal wall and the third straight side, a curved fourth side spaced from the eccentric shaft and a free end interconnecting the straight third and fourth curved sides. A protrusion is formed between and interconnects the straight second side and the curved fourth side and pivotally abuts the eccentric shaft.

3 Claims, 4 Drawing Sheets

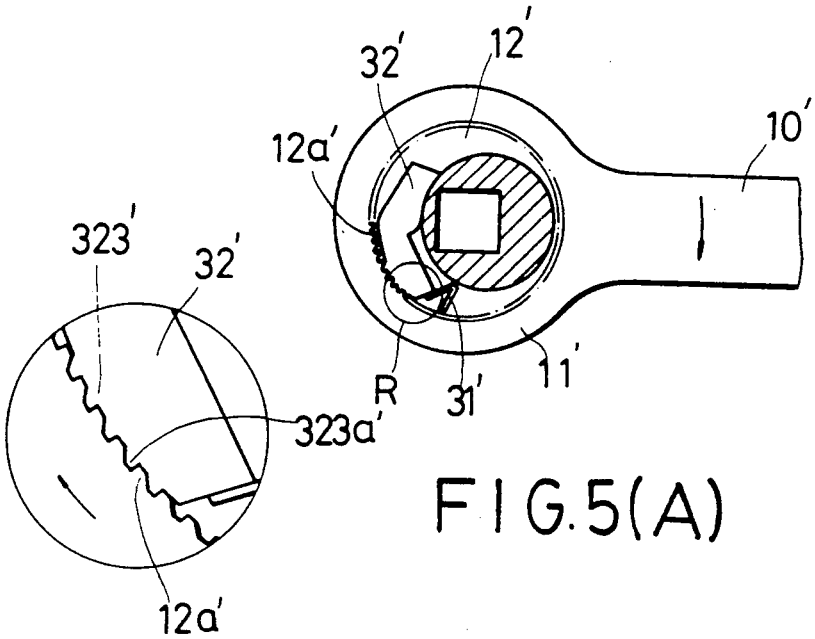
FIG.5(A)
FIG.5(B)
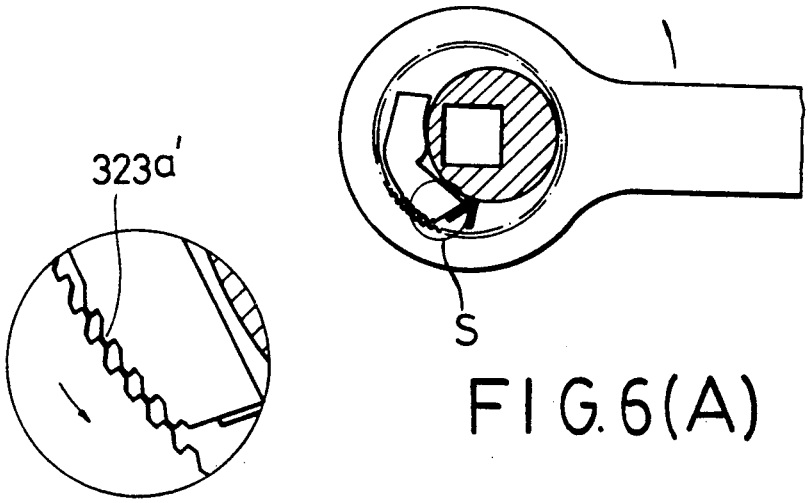
FIG.6(A)
FIG.6(B)

SOCKET WRENCH

BACKGROUND OF THE INVENTION

1. Field of invention

The invention relates to a wrench, more particularly to a socket wrench which has a simple construction and which is easy to manufacture.

2. Description of the Related Art

Sockets for turning nuts, bolts and similar fasteners have found wide acceptance throughout the field of mechanical arts. They generally facilitate turning of such fasteners and generally cause less wear to the fasteners when compared to other types of wrenches, such as adjustable wrenches, box wrenches and open-end wrenches.

Sockets require a compatible drive mechanism that engages the socket and that provides a handle for by applying torque to the socket. Ratchet-type wrenches apply torque to the sockets in one direction and rotate idly relative to the sockets in the opposite direction.

Problems with such ratchet-type wrenches are primarily the result of the complex mechanical arrangement of the ratchet mechanism. The ratchet mechanisms were too delicate for certain applications and were subject to failure from over-stress. In addition, the ratchet mechanism were designed such that they required a certain countertorque from the fastener and the socket before they would ratchet in the opposite direction. When the fastener was sufficiently free to turn so that the countertorque did not develop, the user generally had to supply such force with his free hand. To do this was often inconvenient and awkward and sometimes impossible.

SUMMARY OF THE INVENTION

Therefore, the primary object of the present invention is to provide a socket wrench free from aforesaid drawbacks.

Another object is to provide a socket wrench which has a simple construction and which is easy to manufacture.

Accordingly, a socket wrench of the present invention includes a handle which has a box end with an internal wall that confines a central bore through the box end. A pair of identical rollers, having an eccentric shaft rigidly connected therebetween and a diameter which is smaller than that of the central bore, is disposed in the central bore of the box end. An annular space is formed around the eccentric shaft and is confined by the internal wall of the box end. The annular space has a widest portion on one side of the eccentric shaft and a narrowest portion on the other side of the eccentric shaft. The pair of rollers has a central rectangular opening that passes through the eccentric shaft. A pair of retaining plates are mounted to the box end respectively on both sides of the rollers so as to retain the rollers in the box end. Each of the retaining plates has a central circular hole aligned with the rectangular opening and having a diameter which is smaller than a diagonal length of the rectangular opening. A resilient member is disposed between the two rollers. A rigid pawl member, which is disposed around the eccentric shaft, includes a first section and a second section. Each of the first and second sections has a free end which extend s from the widest portion toward the narrowest portion of the annular space. The first section includes a curved first side formed adjacent to the internal wall of the box end and a straight second side which forms a first clearance between the straight second side and the eccentric shaft. The free end of the first section interconnects the curved first side and the straight second side. The free end of the first section is biased by the resilient member such that a portion of the curved first side adjacent to the resilient member frictionally abuts with the internal wall. The second section includes a straight third side connected to the first curved side and which forms a second clearance between the straight third side and the internal wall, and a curved fourth side spaced from the eccentric shaft and which interconnects the free end of the second section of the pawl member to the straight second side of the first section. A protrusion portion is formed between the straight second side and the curved fourth side and abuts with the eccentric shaft so that the pawl member can pivot about the protrusion. A drive shaft is disposed in the rectangular opening of the identical rollers and has two end portions respectively protruding out from the circular holes of the retaining plates so as to receive a socket member thereat.

BRIEF DESCRIPTION OF THE DRAWINGS

Other features and advantages of the present invention will become apparent in the following detailed description, including drawings, all of which show a non limiting form of the invention, and of which;

FIG. 5(A) shows a cross sectional view of FIG. 4, illustrating the socket wrench when in a torque-applying configuration;

FIG. 5(B) is an enlarged view of the circle "R" shown in FIG. 5(A);

FIG. 6(A) shows a cross sectional view of FIG. 4, illustrating the socket wrench when in an idly-rotating configuration; and FIG. 6(B) is an enlarged view of the circle "S" shown in FIG. 6(A).

DETAILED DESCRIPTION OF THE PREFERRED EMBODIMENT

Figure 1:
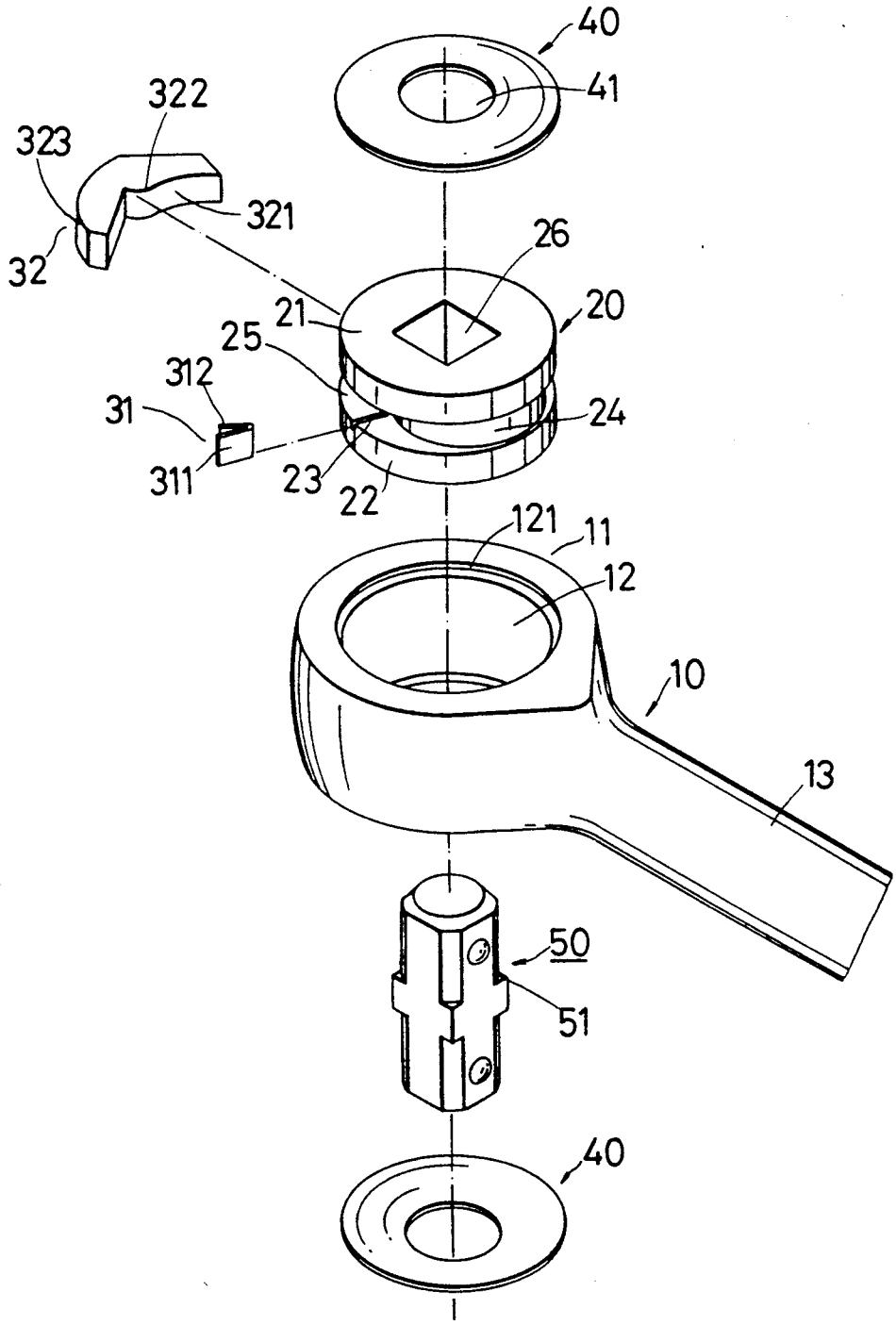
FIG. 1 is an exploded view of a preferred embodiment of a socket wrench according to the present invention.

Referring to FIG. 1, a socket wrench (10) of the present invention includes a handle (13) having a box end (11). The box end (11) has an internal wall (12) that confines a central bore therein. The internal wall (12) has a pair of annular grooves (121) respectively formed adjacent to upper and lower ends thereof.

A rotary member (20) includes a pair of identical rollers (21, 22) connected by an eccentric shaft (24) that is fixed therebetween. The rollers (21, 22) respectively have a diameter which is smaller than that of the internal wall (12) and are disposed in the central bore of the box end (11). The pair of rollers (21, 22) has a central rectangular opening (26) which passes through the eccentric shaft (24). An annular space is formed around the eccentric shaft (24) and is confined by the internal wall (12). The annular space includes a widest portion(25) on one side of the eccentric shaft (24) and a narrowest portion (25') opposite to and on the other side of the eccentric shaft (24).

A pair of retaining plates (40), either flat or arcuate plates, are respectively fixed in the annular grooves (121) of the internal wall (12) of the box end (11) on both sides of the pair of rollers (21, 22), thereby by retaining the identical rollers (21, 22) within the box end (11). The compression method which is used to secure the retaining plates (40) in the box end (11) is well known in the art, and thus, a detailed description of which will not be provided herein. After assembly, the central holes (41) of the retaining plates (40) are aligned with the central rectangular opening (26) of the pair of identical rollers (21, 22). The central holes (41) of the retaining plates (40) have a diameter smaller than the diagonal length of the rectangular opening (26).

A drive member (50) is disposed in the rectangular opening (26) of the rollers (21) and has two free ends that respectively extend out from the central holes (41) of the retaining plates (40) so as to receive a socket for turning a nut. The drive member (50) further has a rectangular shoulder (51) formed at an intermediate portion thereof and is fittingly held by the rollers (21, 22) so as to permit rotation of the drive member (50) with the rollers (21, 22). The retaining plates (40) prevent the drive member (50) from falling out of the rectangular openings (26) of the rollers (21, 22).

A V-shaped resilient member (31) includes a first arm (311) and a second arm (312) inserted in a groove (23) formed on an inner surface of the roller (22). An inverted V-shaped rigid pawl member (32) is provided around the eccentric shaft (24) between the identical rollers (21, 22) and has a first and second sections each with a free end. The pawl member (32) is provided at the widest portion (25) of the annular space such that the free end of each of the sections extends toward the narrowest portion (25') from the widest section. The first section of the pawl member (32) includes a curved first side (323) formed adjacent to the internal wall (12) of the box end (11), a straight second side (325) which forms a first clearance (X) with the eccentric shaft (24) and the free end which interconnects the curved first side (323) and second straight side (325) and which is biased by the second arm (312) of the V-shaped resilient member (31) such that a portion of the curved first side (323) adjacent to the resilient member (31) frictionally abuts the internal wall (12) of the box end (11). The second section of the rigid pawl member (32) includes a third straight side (326) connected to the curved first side (323) and forming a second clearance (Y) between the third straight side(326) and the internal wall (121), a curved fourth side (321) spaced from the eccentric shaft (24), the free end (327) which interconnects the third and fourth sides (326, 321). The pawl member (32) further includes a protrusion (322) formed between the second straight side (325) and fourth curved side (321) and which abuts with the eccentric shaft (24) so that the pawl member (32) can pivot about the protrusion (322).

Figure 2A:
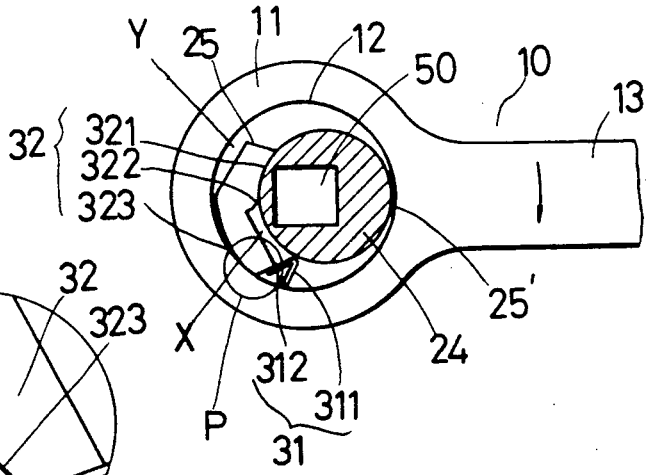
FIG. 2(A) is a cross sectional view of the socket wrench of FIG. 1, illustrating the socket wrench when a torque-applying configuration.
Figure 2B:
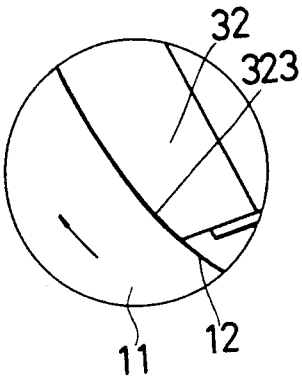
FIG. 2(B) is an enlarged view of the circle "P" of FIG. 2(A)
Figure 3A:
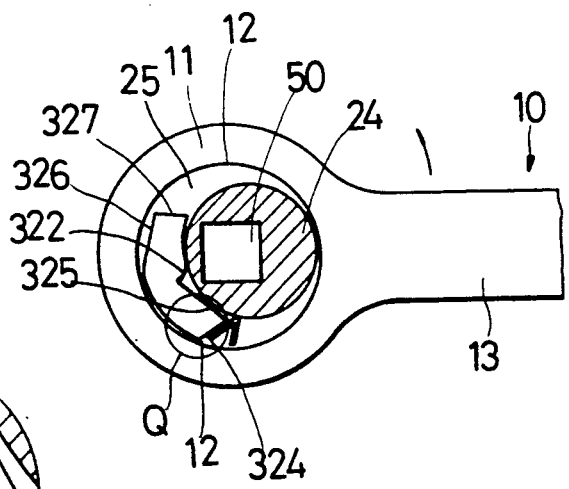
FIG. 3(A) is a cross sectional view of FIG. 1, illustrating the socket wrench when in an idly-rotating configuration.
Figure 3B:
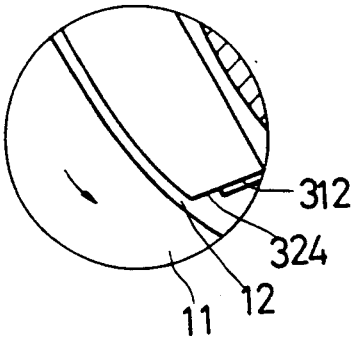
FIG. 3(B) is an enlarged view of the circle "Q" of FIG. 3(A)

Referring to FIGS. 2 and 3, when the handle (13) of the box end (11) is rotated in a clockwise direction as shown by the arrow in FIG. 2, friction between the internal wall (12) of the box end (11) and the curved first side (323) of the pawl member (32) causes the pawl member (32) to rotate with the box end (11). Further rotation of the handle (13) generates greater friction so as to urge the first section of the pawl member (32) to wedge into the narrowest portion (25') of the annular space and simultaneously permit the pawl member (32) to pivot about the protrusion (22) in a clockwise direction. The pivotal action causes the curved fourth side (321) of the pawl member to engage frictionally the eccentric shaft (24), thereby causing the rollers (21, 22) to rotate together with the box end (11) and then correspondingly the drive member (50).

When the handle (13) is rotated in an anti-clockwise direction as shown by the arrow in FIG. 3, the rigid pawl member (32) initially rotates with the box end (11). The first section of the pawl member (32) disengages the narrowest portion (25') of the annular space and pivots about the protrusion (322) in an anti-clockwise direction to bias the resilient member (31), thereby permitting the curved fourth side (321) to disengage the eccentric shaft (24). The pawl member (32) is then pushed toward the widest portion and pivots about the protrusion (322) in a clockwise direction by the resilient member (31) until the curved first side (323) abuts the internal wall (12). Further rotation of the handle (13) rotates the pawl member (31) in an anti-clockwise direction again and allows the curved first and fourth sides (323, 321) to disengage the internal wall (12) and the eccentric shaft (24), as shown in FIG. 3. In this condition, the internal wall (12) of the box end (11) does not engage the pawl member (32) and the pawl member (32) does not engage the eccentric shaft (24) when the handle of the preferred embodiment rotates in the anti-clockwise direction. The box end (11) rotates idly with respect to the rollers (21, 22). The pawl member (32) is constantly retained in the widest portion of the annular space during idle rotation of the wrench.

An important thing to note is that since the rigid pawl member (32) has a simple shape, it is easy to produce the rigid pawl member (32), thereby reducing the manufacturing cost.

Figure 4:
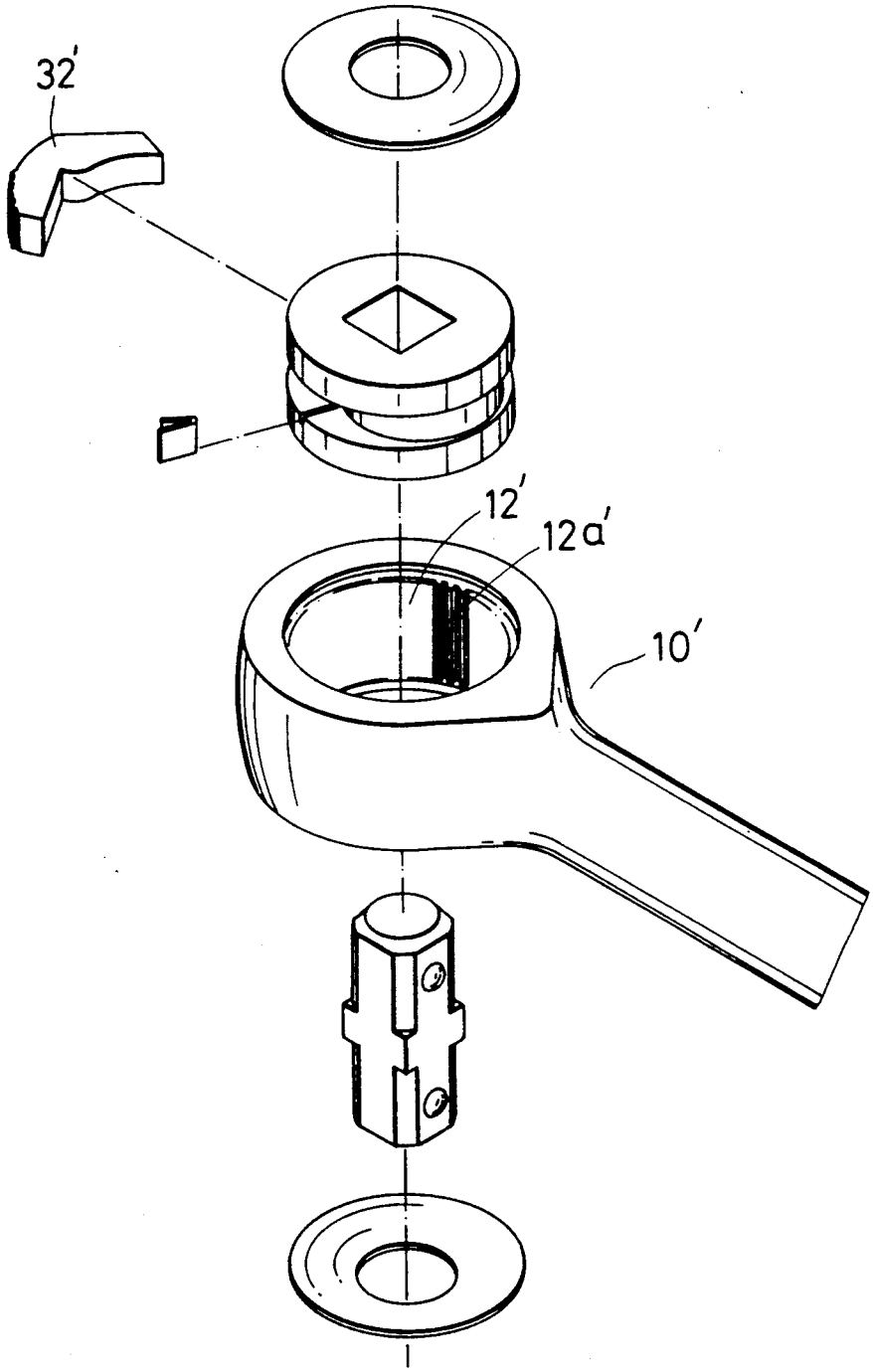
FIG. 4 shows an exploded view of a second preferred embodiment of a socket wrench of the present invention.

Referring to FIG. 4, in another preferred embodiment of the present invention, the internal wall (12') of the box end (11') of the handle (10') has a first set of vertically extending ratchet tooth (12*a*') while the curved first side (323') of the pawl member (32') has a second set of external ratchet teeth (323*a*') which meshes with the vertically extending ratchet tooth (12*a*').

When the handle (10') of the wrench of the present invention is rotated in a clockwise direction as shown by the arrow in FIG. 5, the ratchet teeth (323*a*') of the internal wall (12') engages the ratchet teeth (12*a*') of the pawl member (32') so that a stronger friction force is created between the pawl member (32') and the internal wall (12'). The rollers therefore rotate with the box end (11'). In the event that the handle (10') of the wrench is rotated in an anti-clockwise direction as shown in FIG. 6, ratchet teeth (323*a*', 12*a*') disengage from one another, thereby permitting idle rotation of the box end (11') relative to the rollers. The feature and object of the second preferred embodiment are the same as the previous embodiment. The ratchet mechanism employed in the second embodiment is known in the art and thus, a detailed description of such is omitted herein.

With the invention thus explained, it is obvious to those skilled the art that various modifications and variations can be made without departing from the scope and spirit of the present invention. It is therefore intended that the invention be limited only as indicated in the appended claims.

I claim:

1. A wrench used with a socket member, said wrench comprising:

a handle having a box end with an internal wall that confines a central bore through said box end;

a pair of identical rollers having a diameter smaller than that of said internal wall and being disposed in said central bore of said box end, said pair of identical rollers having an eccentric shaft fixed therebetween and a central rectangular opening passing through said eccentric shaft, an annular space being formed around said eccentric shaft between said pair of identical rollers and being confined by said internal wall, said annular space having a widest portion formed on one side of said eccentric shaft and a narrowest portion formed on the other side of said eccentric shaft opposite to said widest portion thereof, and a resilient member provided between said pair of identical rollers;

a pair of retaining plates mounted to said box end respectively on both sides of said pair of identical rollers so as to retain said pair of rollers in said box end, each of said retaining plates having a circular hole formed therethrough and aligned with said central rectangular opening of said pair of identical rollers, said circular hole having a diameter which is smaller than a diagonal length of said central rectangular opening of said pair of identical rollers;

a drive shaft disposed in said central rectangular openings of said pair of identical rollers and provided with two end portions which respectively protrude out of said circular holes of said retaining plates such that said end portions can be inserted in said socket member to rotate a nut, said drive shaft having a rectangular shoulder formed at an intermediate portion thereof and fittingly held in said rectangular opening so as to permit rotation of said drive shaft with said rollers, said drive shaft being prevented by said retaining plates from falling out of said rectangular opening of said pair of identical rollers;

an inverted V-shaped rigid pawl member disposed around said eccentric shaft and including a first section and a second section, each of said first and second sections having a free end which extends from said widest portion toward said narrowest portion, said first section having a curved first side formed adjacent to said internal wall of said box end, a straight second side forming a first clearance between said straight second side and said eccentric shaft, said free end of said first section interconnecting said curved first side and straight second side and being resiliently biased by said resilient member such that at least a portion of said curved first side adjacent to said resilient member frictionally abuts with said internal wall of said box end, said second section having a straight third side connected to said curved first side and a curved fourth side interconnecting said free end of said second section and said straight second side of said first section, and a second clearance being formed between said straight third side and said internal wall of said box end, said curved fourth side being adjacent to said eccentric shaft, a protrusion portion being formed between said straight second side and said curved fourth side and abutting said eccentric shaft so that said pawl member can pivot about said protrusion;

when said handle is rotated in a first direction, friction between said curved first side of said rigid pawl member and said internal wall of said box end of said handle causes said first section of said rigid pawl member to pivot about said protrusion in said first section, and further allowing said first section of said pawl member to wedge into said narrowest portion of said annular space, and allowing said curved fourth side to frictionally engage said eccentric shaft;

when said handle is rotated in a second direction opposite to said first direction, said friction causes said first section of said rigid pawl member to rotate in said second direction and move toward said widest portion, thereby permitting said curved first side of said first section of said pawl member to disengage said internal wall of said box end and simultaneously permit said curved fourth side of said second section of said pawl member to disengage said eccentric shaft.

2. A wrench as defined in claim 1, wherein said internal wall of said box end is provided with a first set of vertically extending ratchet teeth and said curved first side of said rigid pawl member includes a second set of external ratchet teeth adapted to mesh with said first set of ratchet teeth.

3. A wrench as claimed in claim 1, wherein one of said identical roller has a groove formed on an inner surface, said resilient member is V-shaped and has two arms one of which is inserted in said groove.

* * * * *